US009385484B2

(12) United States Patent
Chen et al.

(10) Patent No.: US 9,385,484 B2
(45) Date of Patent: Jul. 5, 2016

(54) ELECTRICAL CONNECTOR HAVING WATERPROOF FUNCTION

(71) Applicant: FOXCONN INTERCONNECT TECHNOLOGY LIMITED, Grand Cayman (KY)

(72) Inventors: De-Jin Chen, ShenZhen (CN); Yu-San Hsiao, New Taipei (TW); Ming-Lun Szu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/556,253

(22) Filed: Dec. 1, 2014

(65) Prior Publication Data

US 2015/0155661 A1 Jun. 4, 2015

(30) Foreign Application Priority Data

Nov. 29, 2013 (CN) ..... 2013 2 0768567 U

(51) Int. Cl.

| | |
|---|---|
| ***H01R 13/648*** | (2006.01) |
| ***H01R 13/6594*** | (2011.01) |
| ***H01R 13/6582*** | (2011.01) |
| *H01R 24/62* | (2011.01) |
| *H01R 12/70* | (2011.01) |
| *H01R 13/52* | (2006.01) |

(52) U.S. Cl.

CPC ..... *H01R 13/6594* (2013.01); *H01R 13/6582* (2013.01); *H01R 12/707* (2013.01); *H01R 13/521* (2013.01); *H01R 24/62* (2013.01)

(58) Field of Classification Search

CPC ..... H01R 13/6591; H01R 13/6581; H01R 24/62; H01R 23/6873; H01R 23/7073; H01R 23/7063; H01R 23/02; H01R 12/57; H01R 12/707; H01R 12/721; H01R 12/724; H01R 13/658; H01R 13/26; H01R 13/6594; H01R 13/6582; H01R 13/521

USPC ..... 439/607.01, 660, 607.28, 607.35, 439/607.36, 607.4, 939

See application file for complete search history.

(56) References Cited

U.S. PATENT DOCUMENTS 7,364,478 B2 * 4/2008 Xu ..... H01R 4/187 439/730
7,901,221 B1 * 3/2011 Li ..... H01R 13/65802 439/607.28

(Continued)

FOREIGN PATENT DOCUMENTS

TW M456614 7/2013

*Primary Examiner* — Neil Abrams
*Assistant Examiner* — Travis Chambers
(74) *Attorney, Agent, or Firm* — Wei Te Chung; Ming Chieh Chang

(57) ABSTRACT

An electrical connector includes an insulating housing, a plurality of conductive terminals installed in the insulating housing and a metallic shell shielding around the insulating housing. The insulating housing has a mating portion extending forwardly thereof. The metallic shell surrounds to form a mating cavity into which the mating portion extending and a joint communicating with the mating cavity. The conductive terminals are exposed to one face of the mating portion. The joint is filled with soldering material to form a soldering segment. The electrical connector has good waterproof function with the soldering segment in the joint.

16 Claims, 6 Drawing Sheets

(56) References Cited

U.S. PATENT DOCUMENTS

| | | | | |
|---|---|---|---|---|
| 7,922,535 | B1 * | 4/2011 | Jiang | H01R 13/5205 439/271 |
| 8,388,380 | B1 * | 3/2013 | Van der Steen | H01R 13/5202 439/607.36 |
| 2012/0108095 | A1 * | 5/2012 | Liu | H01R 13/5219 439/271 |
| 2012/0231661 | A1 * | 9/2012 | Song | H01R 23/6873 439/607.4 |
| 2013/0183844 | A1 * | 7/2013 | Wang | H01R 24/68 439/271 |
| 2014/0349514 | A1 * | 11/2014 | Yang | H01R 13/6581 439/487 |

* cited by examiner

ELECTRICAL CONNECTOR HAVING WATERPROOF FUNCTION

BACKGROUND OF THE INVENTION

1. Field of the Invention

The present invention generally relates to an electrical connector, and more particularly to an electrical connector having good waterproof function.

2. Description of Related Art

TW patent No. M456614 discloses an electrical connector having waterproof function. The electrical connector includes an insulator, a plurality of terminals secured in the insulator, a metallic shell shielding around the insulator, an insulating housing injection molded around the metallic shell and a rear cover. The metallic shell surrounds the insulator to form a receiving cavity, and thereby a long and narrow gap is formed on the metallic shell communicating with the receiving cavity. The insulating housing surrounds the outer surface of the metallic shell. The insulator and the rear cover are received in the insulating housing and the rear cover is set behind the insulator. Waterproof adhesive material is provided at a rear side of the rear cover so as to form a sealing segment. The rear cover is sandwiched between the insulator and the sealing segment. With a development of the electronic products, the electrical connector is becoming lighter, thinner, shorter and smaller. Although the electrical connector is provided with an insulating housing injection molded around the outer surface of the metallic shell and has a good waterproof effect. But the extra insulating housing makes the volume of the electrical connector be bigger and increases the cost.

In view of the foregoing, an electrical connector with good waterproof function is able to overcome the drawbacks described aforementioned would be desirable.

SUMMARY OF THE INVENTION

Accordingly, an object of the present invention is to provide an electrical connector, the electrical connector has a good waterproof function and a lower cost.

In order to achieve the object set forth, an electrical connector includes an insulating housing, a plurality of conductive terminals installed in the insulating housing and a metallic shell shielding around the insulating housing. The insulating housing has a mating portion extending forwardly thereof. The metallic shell surrounds to form a mating cavity into which the mating portion extending and a welding seam communicating with the mating cavity. The conductive terminals are exposed to one face of the mating portion. The welding seam is filled with soldering material to form a soldering segment.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
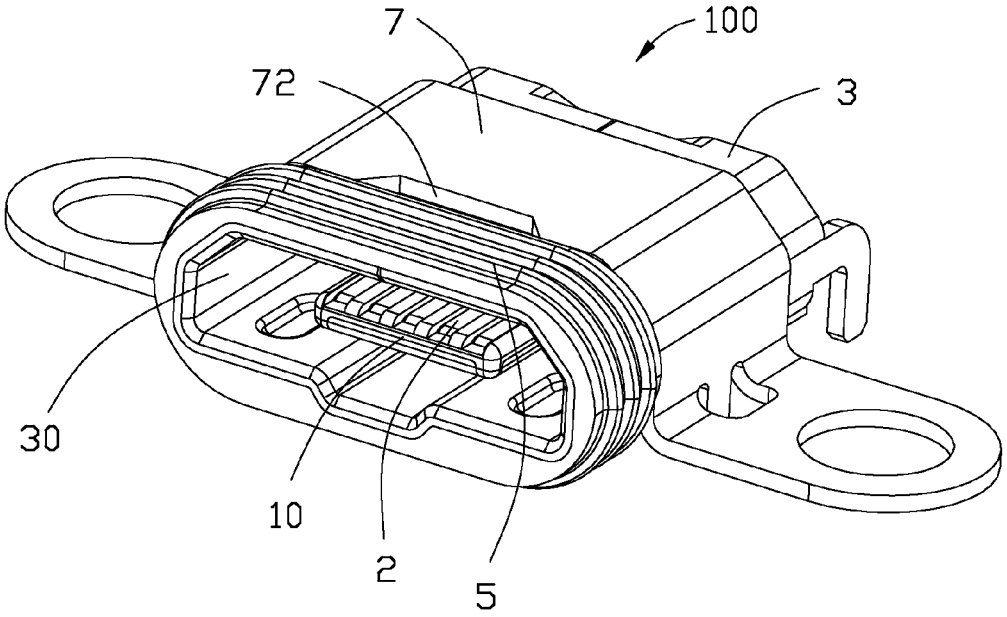
FIG. 1 is a perspective view of an electrical connector of the present invention.
Figure 2:
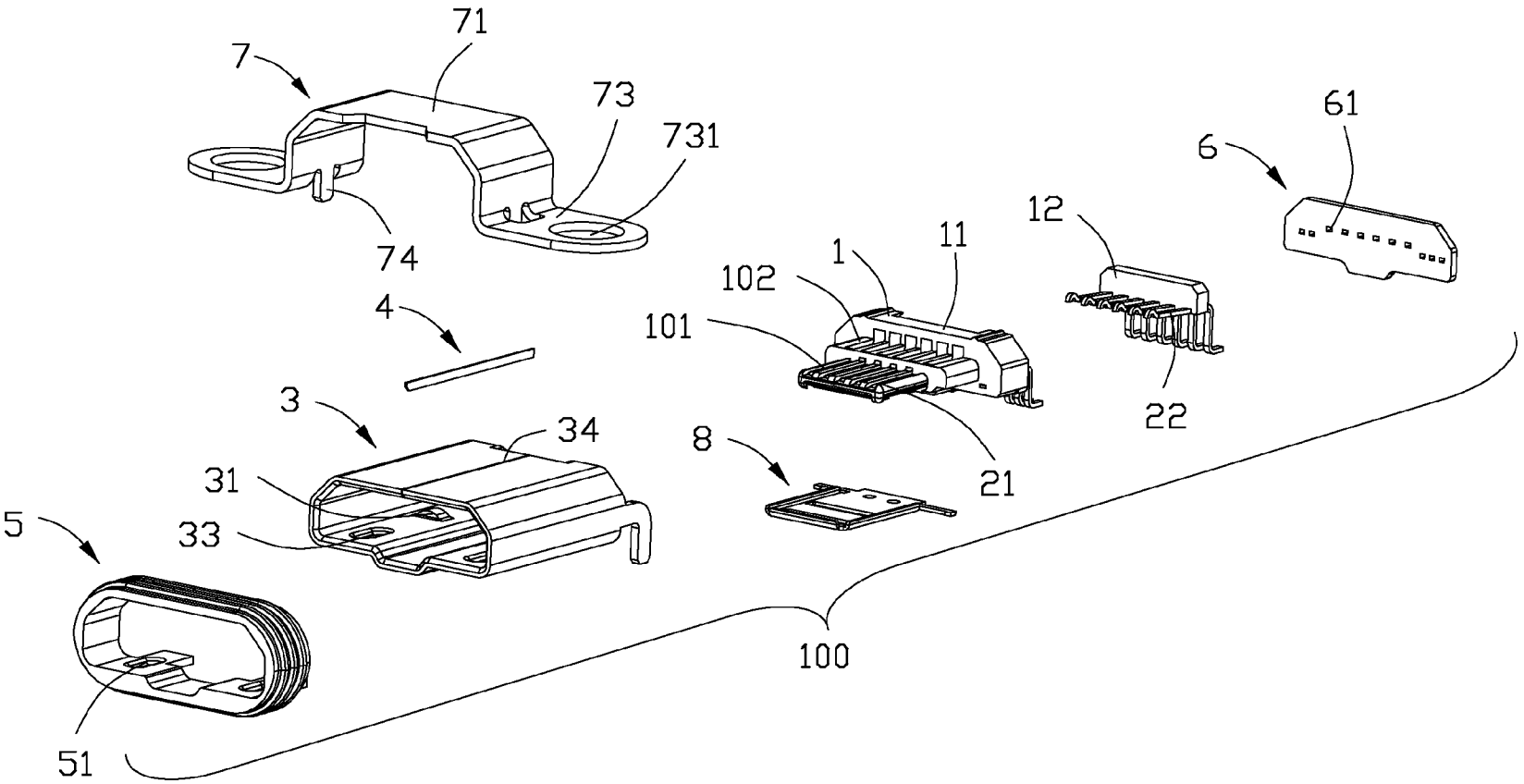
FIG. 2 is an exploded perspective view of the electrical connector in FIG. 1.

Referring to FIG. 1 and FIG. 2, the present invention provides an electrical connector 100 having good waterproof function. The electrical connector 100 comprises an insulating housing 1, a plurality of conductive terminals 2 secured in the insulating housing 1 and a metallic shell 3 shielding around the insulating housing 1. The metallic shell 3 surrounds the insulating housing 1 to form a receiving cavity 30, and thereby forms a threadlike joint or seam 34 between two edges thereof communicating with the receiving cavity 30. The insulating housing 1 has a mating portion 10 extending forwardly into the receiving cavity 30. The conductive terminals 2 are exposed to one face of the mating portion 10. The soldering material is filled in the joint 34 to form a soldering segment 4. The disposition of the soldering segment 4 seals the joint 34 for preventing the liquid material from flowing into the receiving cavity 30.

Figure 3:
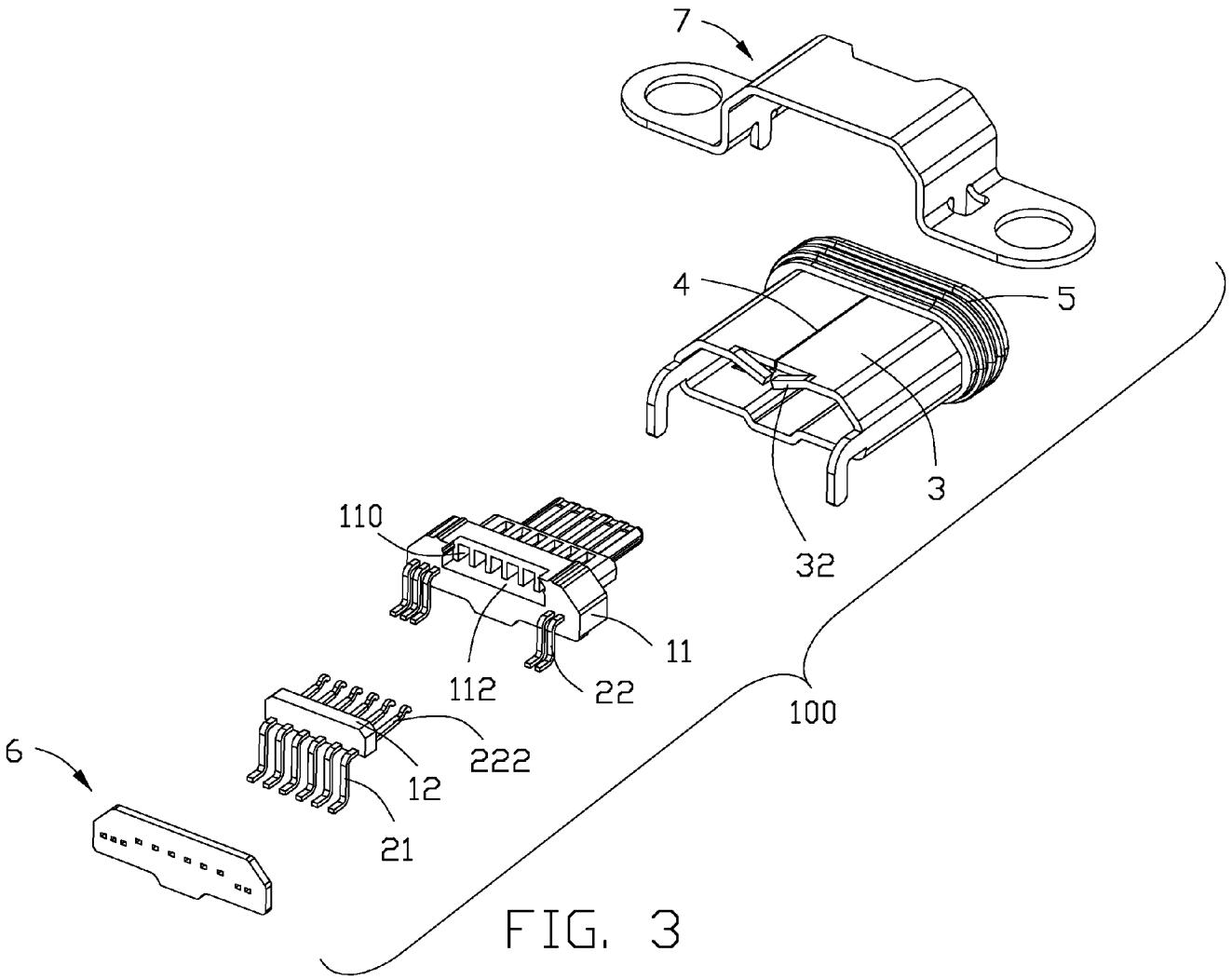
FIG. 3 is a partly exploded perspective view of the electrical connector in FIG. 1.

Referring to FIG. 2 and FIG. 3, the insulating housing 1 comprises a base portion 11 and the mating portion 10 described aforementioned extending forwardly from the base portion 11. The mating portion 10 has a first mating face 101 and a second mating face 102 disposed behind the first mating face 101, thereby the second mating face 102 is placed between the first mating face 101 and the base portion 11. In the present invention, the first mating face 101 is lower than the second mating face 102 in a vertical direction. The conductive terminals 2 comprises a plurality of first terminals 21 and a plurality of second terminals 22. The first terminals 21 are embedded in the base portion 11 and have contacting portions (not labeled) exposed to the first mating face 101. The base portion 11 defines a plurality of mounting holes or passageways 110 running through the base portion 11 in a front-to-back direction. The second terminals 22 and the insulator 12 are initially insert molded to form a terminal module. And then the terminal module is assembled into the base portion 11 in a rear to front direction, thereby contacting portions 222 of the second terminals 22 are exposed to the second mating face 102 after passing through the mounting holes 110. The mating portion 10 is attached with a protecting plate 8 made by metallic material at a face opposite to the first and second mating faces 101, 102. The base portion 11 has an accommodating room 112 recessed from the rear side, and the insulator 12 of the terminal module is installed in the accommodating room 112. Of course, the insulator 12 and the base portion 10 may be inset molded as one element in another embodiment.

The receiving cavity 30 of the metallic shell 3 has a front opening and a rear opening. The insulating housing 1 installed with conductive terminals 2 aforementioned is assembled into the metallic shell 3 from the rear opening, thereby making the mating portion 10 be positioned in the receiving cavity 30 and extend forwardly to the front opening. The receiving cavity 30 is formed by the bending of the metallic shell 3. The joint 34 and soldering segment 4 described aforementioned are formed in the two joint edges of the metallic shell 3. There are many ways to form the soldering segment 4. In this embodiment, the soldering segment 4 is formed in the joint 34 by filled with the soldering material by the technology of laser. The soldering segment 4 is a continuum, and the length thereof is the same as the length of joint 34 in the front-to-back direction.

The metallic shell 3 defines a first stopping portion 31 protruding into the receiving cavity 30 from an inner surface thereof and in front of the insulating housing 1 and a second stopping portion 32 unitarily bent from a rear side thereof and placed behind the insulating housing 1. The disposition of the first and second stopping portions 31, 32 are used for retaining the insulating housing 1 after the insulating housing 1 is assembled into the metallic shell 3. The first stopping portion 31 can also prevent the complementary connector from over-insertion. In the present embodiment, there are two opposite second stopping portions 32 bending from the rear side of the metallic shell 3 and disposed in a triangle. What's more, the metallic shell 3 defines two blocks (not labeled) protruding outwardly from the inner surface thereof and in front of the first stopping portion 31, correspondingly, two latching slots 33 are formed in the inner surface of the metallic shell 3. The latching slots 33 are used for latching with the complementary connector when the two connectors are mating with each other. A circular rubber 5 is disposed in the outer surface of the metallic shell 3. The circular rubber 5 is formed by pouring rubber material on the outer surface of the metallic shell 3 and forms two recesses 51 corresponding to the blocks aforementioned.

Figure 4:
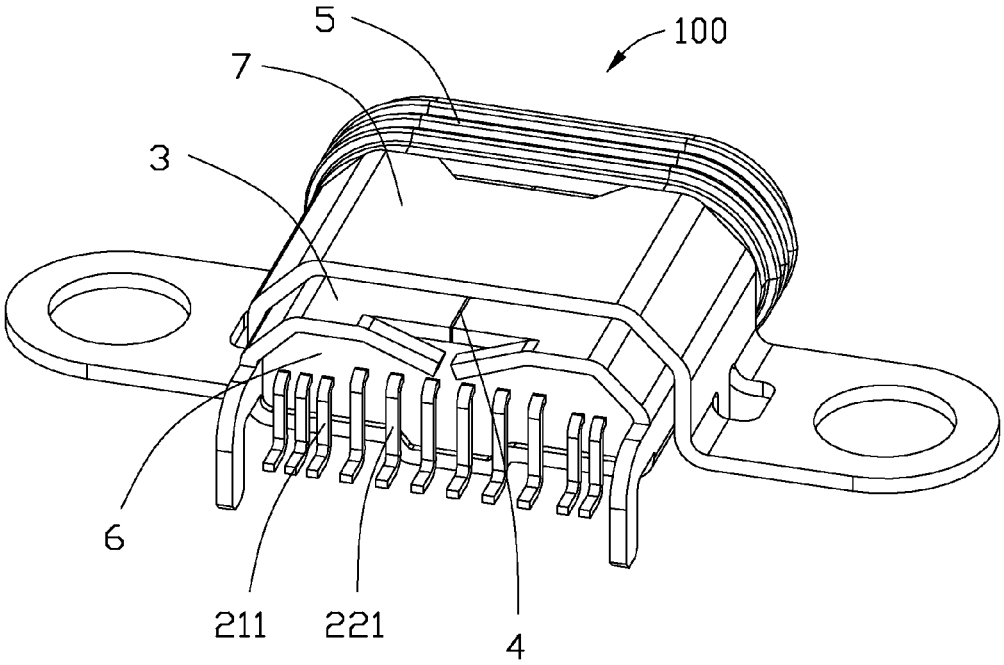
FIG. 4 is another perspective view of the electrical connector in FIG. 1.

Referring to FIG. 2 and FIG. 4, a sealing segment 6 is formed at the rear side of the insulating housing 1. The sealing segment 6 is formed by pouring the waterproof adhesive material on the rear side of the insulating housing 1 and is positioned between the rear side of the insulating housing 1 and the second stopping portions 32. The second stopping portions 32 are adjacent to a rear side of the sealing segment 6. The first terminals 21 have first soldering portions 211 protruding out of the insulating housing 1, and the second terminals 22 have second soldering portions 221 protruding out of the insulating housing 1, too. After separating the sealing segment 6 from the terminal module, we will find that a plurality of holes 61 are formed in the sealing segment 6 for wrapping around the terminals 21, 22. The first and second soldering portions 211, 221 protrude out of the electrical connector 100 from the holes 61. The first soldering portions 211 are divided into two groups which are separately disposed at two sides of the second soldering portions 221. In this embodiment, the holes wrapped around the first soldering portions 211 are lower than the holes wrapped around the second soldering portions 221.

The electrical connector 100 comprises a bracket 7 having a shielding portion 71 surrounding the metallic shell 3 at three faces. The front side of the shielding portion 71 is behind and adjacent to the rear side of the circular rubber 5. The cutting portion 72 is positioned between the shielding portion 71 and the circular rubber 5 which is used for preventing the circular rubber 5 from being damaged when welding the bracket 7 to the metallic shell 3. The rear side edge of the shielding portion 71 is in front of the rear side edge of the metallic shell 3. The bracket 7 has two retaining portions 73 bending outwardly and two soldering legs 74 extending downwardly from two sides of the shielding portion 71. Each of the retaining portions 73 is recessed with a retaining hole 731 and is perpendicular to the soldering leg 74. The disposition of the retaining portions 73 and the soldering legs 74 are used for mounting the electrical connector 100 on a printed circuit board. In this embodiment, the first terminals 21 are insert-molded within the base portion 11 as a first terminal module with the corresponding stationary contacting sections exposed upon one mating face on a mating tongue of the housing 1, and the second terminals 22 are insert molded within the insulator 12 as a second terminal module with the corresponding deflectable contacting sections inserted into the corresponding passageways in the base portion 11 and exposed upon another mating face of the mating tongue after the insulator 12 is assembled to the base portion 11.

Figure 5:
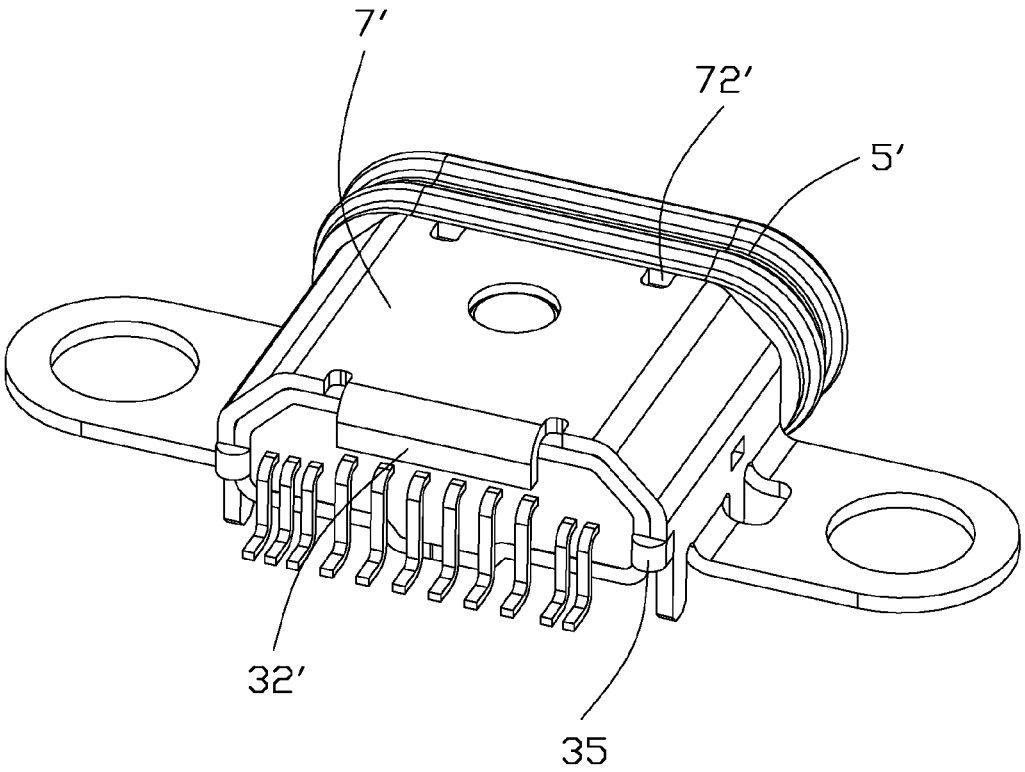
FIG. 5 is a perspective view of an electrical connector of another embodiment of the present invention.
Figure 6:
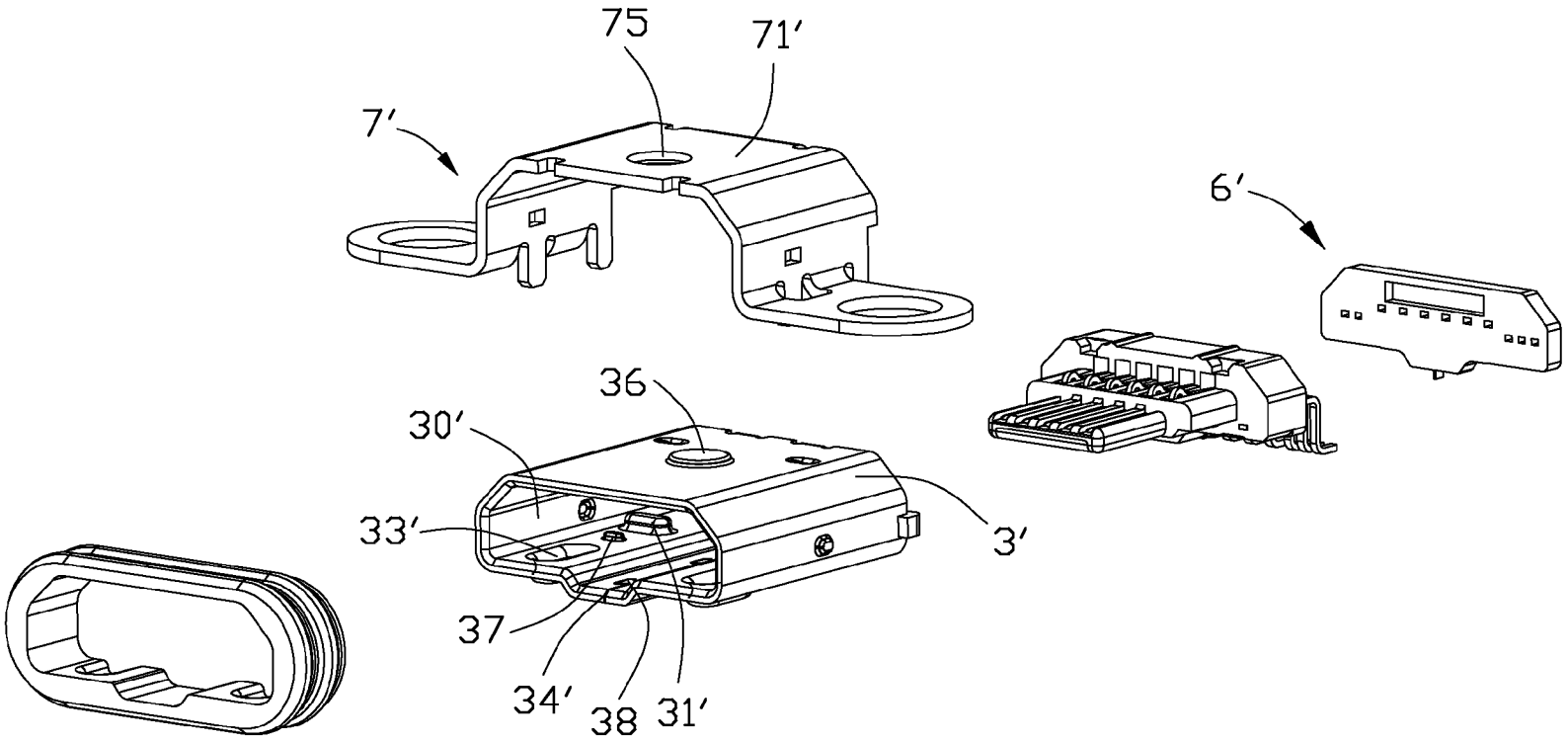
FIG. 6 is a partly perspective view of the electrical connector in FIG. 5.

FIG. 1 to FIG. 4 are taken to describe the electrical connector 100 of the first embodiment of the present invention. FIG. 5 and FIG. 6 are combined to introduce the electrical connector of another embodiment hereinafter. The main structures of the electrical connector of the second embodiment are roughly the same as the electrical connector 100 of above embodiment. In this part, we will only introduce the differences. The metallic shell 3' defines two fourth stopping portions 37 protruding into the receiving cavity 30' and positioned between the first stopping portions 31' and the latching slots 33'. The disposition of the fourth stopping portions 37 are used for preventing the complementary connector from over-insertion. The metallic shell 3' defines at least one swallow-tail shaped protruding portion 38 in one side edge facing to the joint 34' thereof and a latching hole corresponding to the protruding portion 38. The soldering material is filled into the gaps between the protruding portions 38 and the latching holes so as to form a part of the soldering segment 4. That is to say, the gaps are a part of the joint 34'. The protruding portions 38 and the latching holes are used for preventing the soldering segment from taking off the joint 34'.

In this embodiment, the front side and the rear side of the shielding portion 71' of the bracket 7 are both provided with cutting portions 72' for firmly fixing the bracket 7' with the metallic shell 3'. The cutting portions 72' in the front side of the shielding portion 71' face to the circular rubber 5', and the cutting portions 72' in the rear side of the shielding portion 71' face to the rear direction and are configured as open-shaped. The shielding portion 71' is aligned with the metallic shell 3' at the rear side edge thereof. The metallic shell 3' defines two third stopping portions 35 extending outwardly from two sides of a rear portion thereof. The third stopping portions 35 are disposed behind the shielding portion 71' for fixing the shielding portion 71'. Besides, the shielding portion 71' of the bracket 7' defines a fixing hole 75, and the metallic shell 3' defines a retaining post 36 protruding outwardly therefrom corresponding to the fixing hole 75. The metallic shell 3' bends to form a second stopping portion 32' from the rear side thereof to adjacent to the rear face of the sealing segment 6'. The second stopping portion 32' is positioned above the terminals and is used for preventing the terminal module and the sealing segment 6' from moving back.

In a conclusion, the electrical connector 100 defines a soldering segment 4 in the seam 34' of the metallic shell 3' in which formed by being filled with the soldering material by laser technology and a sealing segment 6 formed by filling the waterproof adhesive material into the rear side thereof, thereby getting good waterproof function.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulating housing comprising a mating portion extending forwardly;

a plurality of conductive terminals installed in the insulating housing and exposed to a face of the mating portion; and a metallic shell surrounding the insulating housing to form a mating cavity into which the mating portion extending forwardly and a joint communicating with the mating cavity;

wherein the joint is filled with soldering material to form a soldering segment; wherein the metallic shell defines at least one swallow-tail shaped protruding portion and a latching hole corresponding to the protruding portion around the joint, the soldering material is filled into gaps between the protruding portion and the latching hole to form a part of the soldering segment.

2. The electrical connector as claimed in claim 1, wherein the soldering segment is formed by filling the soldering material into the joint by using a technology of laser.

3. The electrical connector as claimed in claim 2, wherein the soldering segment is a continuum and as the same as the joint in size along a front to back direction.

4. The electrical connector as claimed in claim 3, wherein the metallic shell has a first stopping portion protruding into the mating cavity from an inner surface thereof and being positioned in front of the insulating housing and a second stopping portion unitarily bending downwardly from a rear side thereof and being positioned behind the insulating housing.

5. The electrical connector as claimed in claim 4, wherein the metallic shell has two blocks recessed from the inner surface in front of the first stopping portion and protruding outwardly therefrom, a circular rubber is provided around the outer surface of the front portion of the metallic shell, and the circular rubber is poured on the outer surface of the metallic shell and has two latching holes corresponding to the blocks.

6. The electrical connector as claimed in claim 5, wherein the electrical connector comprises a bracket surrounding the metallic shell at three faces to form a shielding portion, a front side of the shielding portion is adjacent to a rear side of the circular rubber and defines at least one cutting portion thereof, thereby the cutting portions is positioned between the circular rubber and shielding portion.

7. The electrical connector as claimed in claim 4, wherein a sealing segment is provided behind and attached to the insulating housing, the sealing segment is between a rear face of the insulating housing and the second stopping portion.

8. The electrical connector as claimed in claim 7, wherein the conductive terminals comprise a plurality of first terminals and second terminals provided with first soldering portions and second soldering portions, respectively, the sealing segment has a plurality of holes shielding around the first and second soldering portions, the first soldering portions are divided in to two groups which are disposed at two sides of the second soldering portions.

9. The electrical connector as claimed in claim 8, wherein the mating portion comprises a first mating face and a second mating face which positioned in a same side of the mating portion, the first terminals are exposed to the first mating face, and the second terminals are exposed to the second mating face.

10. The electrical connector as claimed in claim 9, wherein the first and second mating faces are in different planes, and the second mating face is behind the first mating face.

11. The electrical connector as claimed in claim 10, wherein a protecting segment is provided to attach to another face of the mating portion opposite to first and second faces.

12. An electrical connector assembly comprising:

a first terminal module including a plurality of first terminals integrally formed with an insulative base portion via an insert molding process, stationary contacting sections of said first terminals being exposed upon a first mating face of a mating tongue of said base portion;

a second terminal module including a plurality of second terminals integrally formed with an insulator via another insert molding process, deflectable contacting sections of said second terminals being inserted into corresponding passageways in the base portion and exposed upon a second mating face of said mating tongue after said insulator is assembled to the base portion to commonly form an insulative housing; and a metallic shell enclosing said assembled insulative housing and defining thereof a seam adapted to be soldered: wherein the passageways extend along a front-to-back direction so as to have the insulator assembled to the base portion only along the front-to-back direction, further including a sealant applied upon a rear side of the housing while exposing tails of said first terminals and those of the second terminals.

13. The electrical connector assembly as claimed in claim 12, further including a metallic bracket fastened to the shell.

14. The electrical connector assembly as claimed in claim 12, wherein the shell and the bracket are soldered together around said seam.

15. The electrical connector assembly as claimed in claim 12, wherein a metallic shielding plate is embedded within the mating tongue via said insert molding process.

16. An electrical connector assembly comprising:

a first terminal module including a plurality of first terminals integrally formed with an insulative base portion via an insert molding process, stationary contacting sections of said first terminals being exposed upon a first mating face of a mating tongue of said base portion;

a second terminal module including a plurality of second terminals integrally formed with an insulator via another insert molding process, deflectable contacting sections of said second terminals being inserted into corresponding passageways in the base portion and exposed upon a second mating face of said mating tongue after said insulator is assembled to the base portion to commonly form an insulative housing; and a metallic shell enclosing said assembled insulative housing and defining thereof a seam adapted to be soldered: wherein the passageways extend along a front-to-back direction so as to have the insulator assembled to the base portion only along the front-to-back direction, further including a metallic bracket fastened to the shell; wherein the shell and the bracket are soldered together around said seam.

* * * * *